US005611431A

United States Patent [19]

Harris

[11] Patent Number: 5,611,431

[45] Date of Patent: Mar. 18, 1997

[54] WRAP-AROUND CARRIER FOR PACKAGING THREE ROWS OF ARTICLES

[75] Inventor: Randall L. Harris, Powder Springs, Ga.

[73] Assignee: Riverwood International Corporation, Atlanta, Ga.

[21] Appl. No.: 566,237

[22] Filed: Dec. 1, 1995

[51] Int. Cl.[6] ..... B65D 65/24

[52] U.S. Cl. ..... 206/434; 206/153; 206/526

[58] Field of Search ..... 206/427, 433, 206/434, 153, 158–161, 526

[56] References Cited

U.S. PATENT DOCUMENTS

| | | | |
|---|---|---|---|
| 3,674,136 | 7/1972 | Forrer | 206/153 |
| 4,184,626 | 1/1980 | Graser et al. | 206/434 X |
| 5,310,051 | 5/1994 | Sutherland | 206/153 |
| 5,328,024 | 7/1994 | Sutherland | 206/158 |
| 5,538,133 | 7/1996 | Campbell et al. | 206/427 |

*Primary Examiner*—Byron P. Gehman

[57] ABSTRACT

A wrap-around carrier for packaging three rows of beverage cans or other related articles. A reinforcing strip having clip-type support panels at either end is glued to the underside of the top panel of the carrier. The support panels assist in supporting the end cans of the middle row to prevent the end cans from falling out of the open ends of the carrier and also provide a two-ply handle construction.

14 Claims, 3 Drawing Sheets

WRAP-AROUND CARRIER FOR PACKAGING THREE ROWS OF ARTICLES

FIELD OF THE INVENTION

This invention relates to wrap-around article carriers. More particularly, it relates to a wrap-around carrier capable of carrying articles arranged in three rows.

BACKGROUND OF THE INVENTION

Wrap-around carriers are commonly used to package beverage cans and other articles. Basically, wrap-around carriers are formed by grouping articles in the arrangement they will be in after packaging, then wrapping a carrier blank around the group. The blank is tightly drawn about the articles and the ends of the blank are connected to each other, typically at the bottom of the carrier. Cutouts are often provided at the upper and lower portions of the side panels in order to grip the end portions of articles protruding through the cutouts and allow the blank to be even more tightly wrapped. Wrap-around carriers are economical and sturdy and are well accepted by the public.

Wrap-around carriers by their nature have been limited as to the number of articles they can hold. Normally, articles are arranged in two adjacent rows, so that the sides of the carrier engage the outer portions of the articles in each row while the inner portions of the articles in the rows are in abutting relationship. In this manner the rows of articles are securely held in place against outward movement through the open ends of the carrier. If three rows were to be packaged the risk of articles being squeezed out through the open ends of the carrier is increased since the articles in the middle row would not be in contact with the wrapper but would be held in place only by the pressure exerted by adjacent articles in the adjacent outer rows. Because wrap-around carriers normally can accommodate only two rows of articles, the number of articles that can be packaged is governed to a large extent by the desirable length of the package. Packages containing six articles are the most common, although packages containing eight articles can also be conveniently handled. Depending on the size of the articles, packages containing more than eight articles of the size of beverage cans are not convenient to handle.

It would be highly desirable to be able to package three rows of articles in a wrap-around carrier in order to increase the number of articles which can conveniently be packaged. It is therefore an object of the invention to provide a wrap-around carrier capable of packaging three rows of articles.

BRIEF SUMMARY OF THE INVENTION

The invention is comprised of a wrap-around carrier which includes a reinforcement panel adhered to the inner surface of the top panel. The reinforcement panel includes a pair of oppositely spaced support panels at each end of the top panel. Each support panel has spaced end portions which are foldably connected to the reinforcement panel and an intermediate portion which is spaced from the reinforcement panel. The upper edge of the spaced intermediated portion is adjacent the underside of the flange of an end article in the package and engages the underside of the flange upon the package being lifted by the handle. By this means the end articles in the middle row are positively supported in addition to being held in place by the wrap-around carrier, thereby preventing the end articles in the middle row from being squeezed out the open ends of the carrier.

In a preferred arrangement the support panel takes the form of a reinforcement strip extending between the pairs of support panels and between a pair of spaced handle openings in the top panel. The reinforcement strip does not interfere with the ability of a customer to lift the carrier by the handle or with the ability of the support panels to support the articles by their flanges. The invention is particularly well adapted to be incorporated in a wrap-around carrier containing twelve beverage cans arranged in three rows of four cans in each row.

The features of the invention which enable it to provide the desired results are brought out in more detail in the description of the preferred embodiment, wherein the above and other aspects of the invention, as well as other benefits, will readily become apparent.

DETAILED DESCRIPTION OF THE PREFERRED EMBODIMENTS

Figure 1:
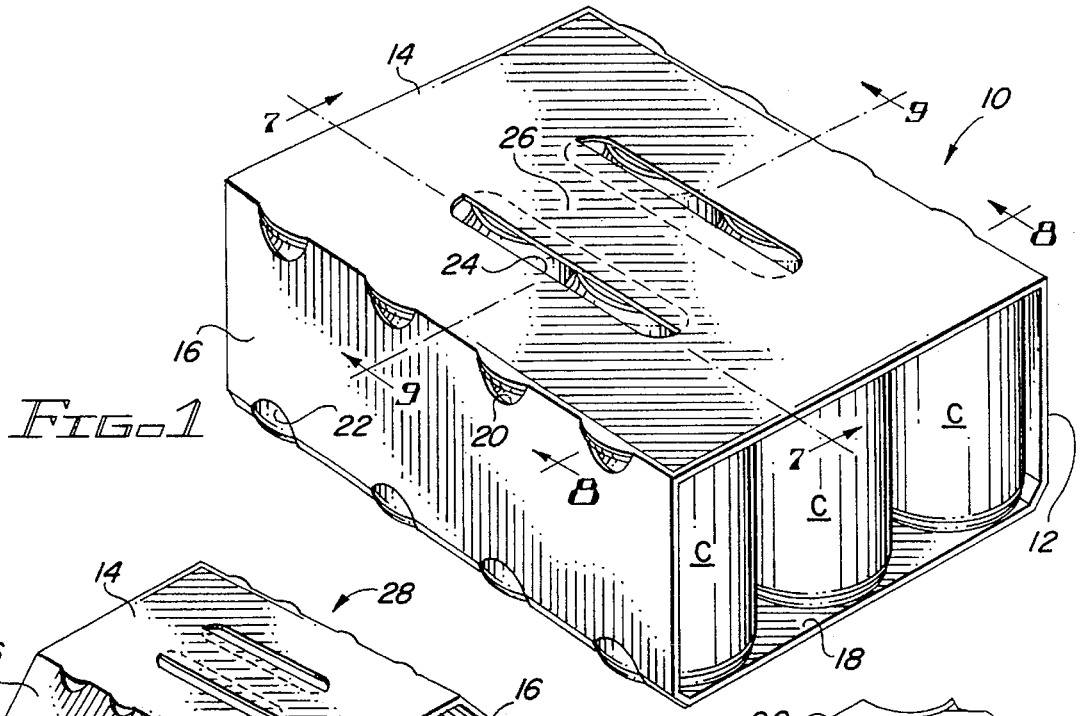
FIG. 1 is a pictorial view of a wrap-around carrier of the present invention containing three rows of beverage cans.

Referring to FIG. 1, a package 10 is comprised of wrap-around carrier 12 and twelve beverage cans C contained within the carrier in three adjacent rows of four cans in each row. The carrier includes top panel 14 connected to side panels 16, which in turn are connected to bottom panel 18. Cutouts 20 in the upper portion of the side panels are located so that top portions of the cans in the outer rows protrude through them. Heel cutouts 22 in the lower portion of the side panels are similarly located to allow lower portions of the cans in the outer rows to protrude. A handle is provided in the top panel by hand openings 24 which are spaced apart a sufficient distance to enable the portion of the top panel between them to function as a carrying strap 26. Although it is not visible in the view of FIG. 1, the structure of the carrier enabling it to securely carry three rows of cans will be made clear below.

Figure 2:
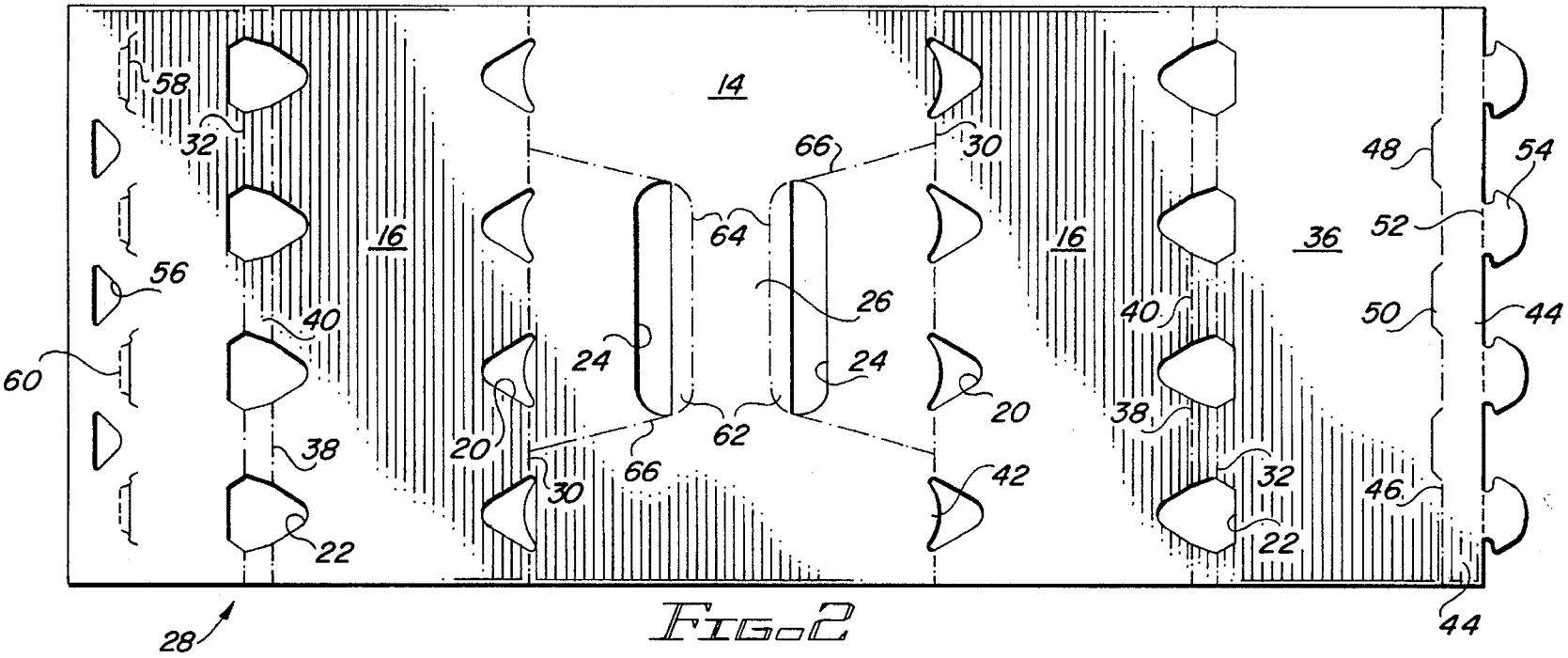
FIG. 2 is a plan view of a blank for forming the main wrap-around portion of the carrier of FIG. 1.

Referring to FIG. 2, a primary blank 28 for forming the wrap-around carrier is a generally rectangular sheet of paperboard or other material having sufficient strength and flexibility to be folded into place and function as a carrier. Top panel section 14 is arranged centrally of the blank and is connected by fold lines 30 to side panel sections 16, which are connected by fold lines 32 to bottom panel flaps 34 and 36. Fold lines 38 in the side panel sections are spaced a short distance from the fold lines 32 to form bevel panel sections 40, which may be considered to be part of the side panel sections. The cutouts 22 extend through the bevel panel sections and into the bottom panel flaps in a manner known in the art. The cutouts 20 interrupt the fold lines 30, forming short tabs 42 which cover the tops of protruding portions of cans in a carrier formed from the blank.

The bottom panel flap 36 includes a locking panel 44 formed by fold line 46. Interrupting the fold line 46 are slits 48 which form three primary locking tabs 50, and connected to the locking panel by fold lines 52 are secondary locking tabs 54. The bottom panel flap 34 includes three primary locking openings 56 which are aligned with the primary locking tabs 50 and four secondary locking slits 58 which are aligned with the secondary locking tabs 54. Spaced fold lines 60 form flaps which yield to permit easy entry of the tabs 54.

The handle cutouts 24 in the top panel section are partially covered by flaps 62 connected to the top panel section by parallel fold lines 64. The carrying strap 26 of the top panel is the portion between the fold lines 64. Preferably, angled score lines 66 extend from the ends of the handle cutouts to the fold lines 30 to distribute lifting stresses to the fold lines. It will be understood that the fold lines 30, 32, 38 and 46 are parallel to each other.

Figure 3:
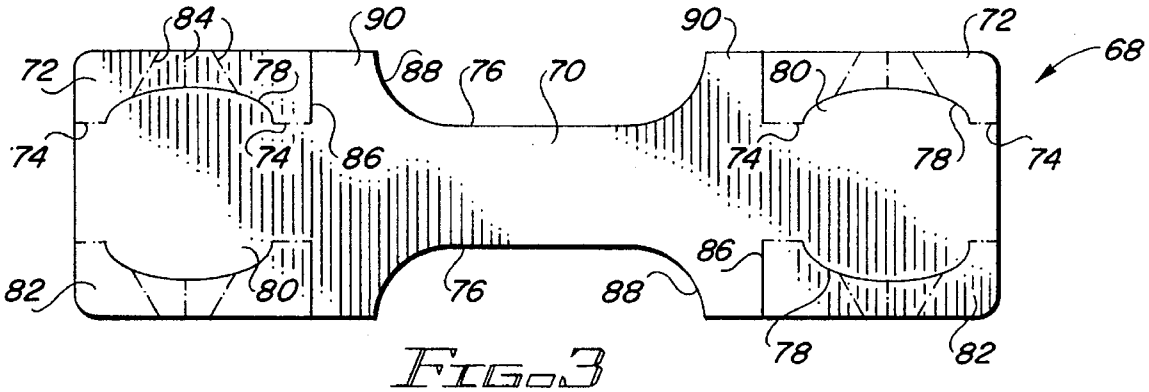
FIG. 3 is a plan view of a clip-type reinforcing strip used in forming the carrier of FIG. 1.

In addition to the wrap-around carrier blank 28, the invention also makes use of a secondary blank in the form of the clip-style reinforcement strip 68 shown in FIG. 3. The strip includes a band or strap portion 70 connected at its ends to wider clip portions 72. The clip portions are identical, making the blank symmetrical in shape. The clip portions include score lines 74 which are aligned with the edges 76 of the strap 70. Interrupting the score lines 74 are arcuate slits 78 which form tabs 80. The tabs 80 in one clip portion 70 are spaced from the tabs 80 in the other clip portion by an amount causing the clip portions to overlie the end cans in a row of four cans. Support panels 82 are formed in the clip portions 72 by the score lines 74 and the slits 78. Preferably, score lines 84, which extend from the slits 78 to the edge of the support panels 82, are provided to distribute lifting stresses. The support panels 82 are separated from the wide clip portions 72 by transverse slits 86, and the edges 88 which connect the clip portion to the strap portion are curved in substantially the same manner as the ends of the handle cutouts. The segments 90 of the clip portion between the slits 86 and the curved edges 88 are adapted to underlie the top panel of the carrier to provide added support between the handle openings and the support panels of the reinforcement strip.

Figure 4:
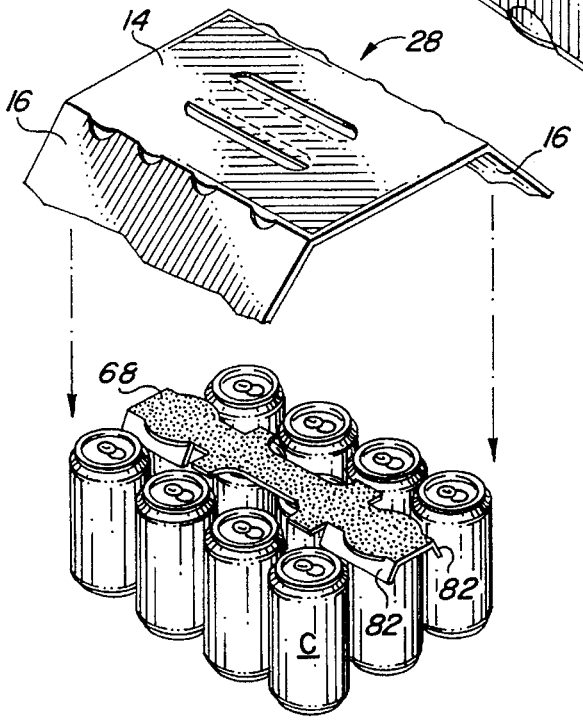
FIG. 4 is a pictorial view of the clip-type strip after it has been applied to the middle row of beverage cans, with the primary wrap-around carrier blank ready to be applied.
Figure 5:
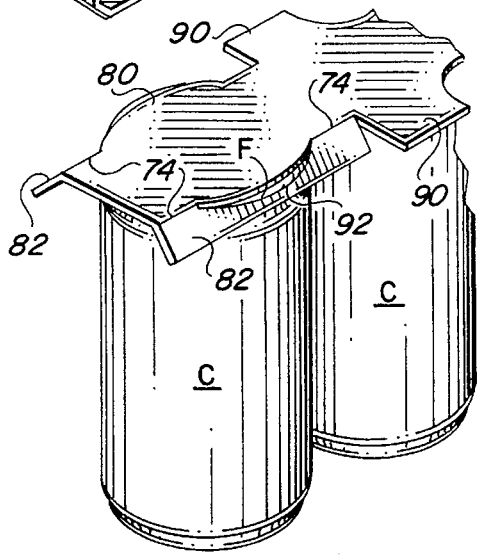
FIG. 5 is an enlarged partial pictorial view of the clip-type reinforcing strip after it has been applied to the middle row of cans.

To form a package from the blanks 28 and 68, twelve beverage cans are arranged in three adjacent rows of four cans in each row as shown in FIG. 4. The reinforcement strip 68 is then placed over the middle row of cans so that the tabs 80 overlie the end cans of the row. As shown more clearly in FIG. 5, downward pressure on the support panels 82 of the reinforcement strip causes them to fold downwardly about the score lines 74, creating openings 92 from the slits 78 in the reinforcement strip blank through which the chimes or flanges F of the beverage cans extend. The edges of the support panels 82 formed by the slits 78 of the blank 68 snap down over the chimes, positioned at the reduced diameter portion of the cans just below the chimes. The primary wrap-around blank 28 is schematically shown in FIG. 4 as being positioned in partially folded condition above the cans, ready to be tightly wrapped about the cans and the attached reinforcement strip and to be glued to the reinforcement strip as indicated by the stippling on the strip.

To complete the formation of the carrier, when the bottom flaps are folded in toward each other the flap 36 overlaps the flap 34. The primary locking tabs 50 are inserted into the locking openings 56 and the secondary locking tabs 54 are inserted through the slits 58 in a manner well known in the industry to form a secure bottom panel from the bottom panel flaps.

Figure 6:
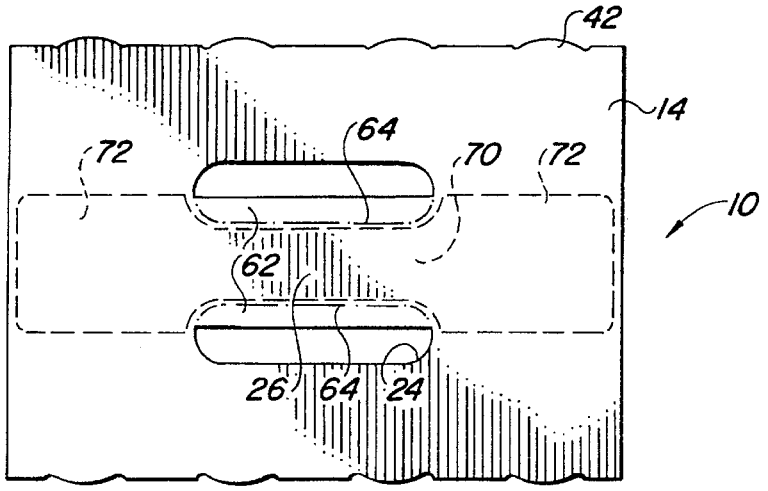
FIG. 6 is a top plan view of the carrier, showing the location of the reinforcement strip in phantom lines.

As shown in FIG. 6, the strap portion 70 of the reinforcement strip is aligned with the handle strap 26 of the top panel of the finished carrier and the wide end portions 72 of the reinforcement strip are located so as to overlie the end cans in the middle row. As indicated above, the curved edges of the strap portion 70 preferably are adjacent the curved inner edges of the handle openings 24 in order to add support to this area of the top panel of the carrier.

Figure 8:
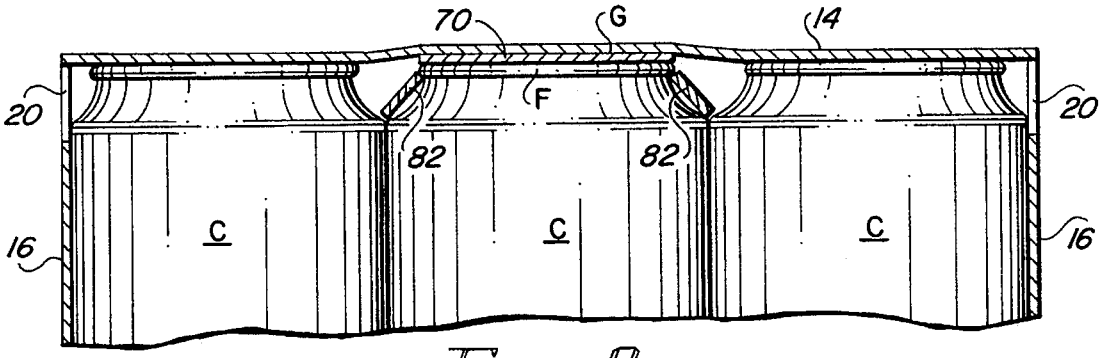
FIG. 8 is an enlarged partial sectional view of the carrier package taken on line 8—8 of FIG. 1.
Figure 7:
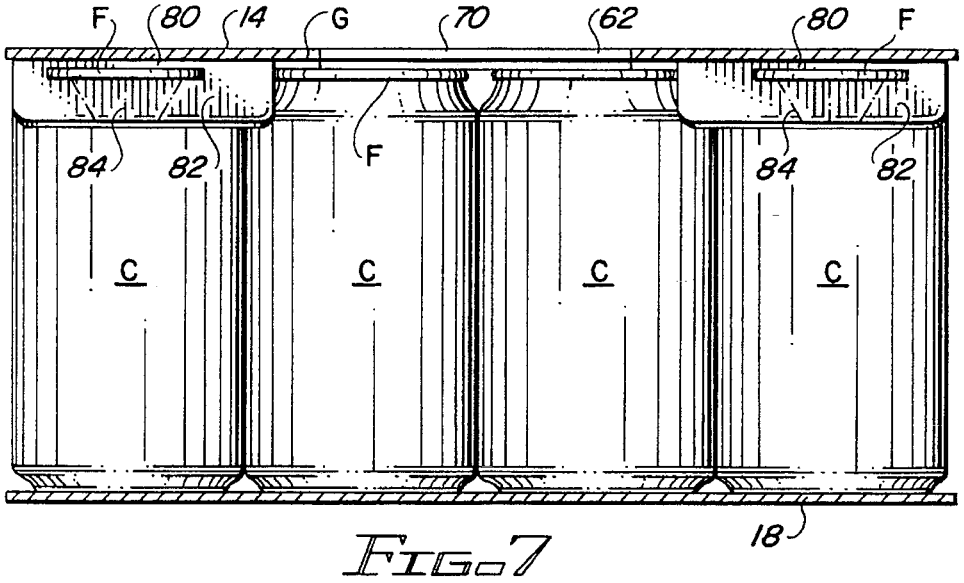
FIG. 7 is an enlarged sectional view of the carrier package taken on line 7—7 of FIG. 1.

The relationship of the reinforcement strip to the primary wrap-around carrier and the beverage cans is best illustrated in FIGS. 7 and 8, which show the support panels of the reinforcement strip to be folded down so that the upper edges of the openings 86 in the support panels contact the cans beneath their flanges F. When lifting the carrier by the handle, the flexibility of the top panel and the reinforcement strip result in the handle strap being raised a slight distance above the rest of the top panel. This provides ample room for the fingers of a customer to fold the handle opening flaps 62 down and to extend the fingers between the strap and the cans. The design of the central portion of the carrier, whereby the strap portion 70 of the reinforcement strip overlies the tops of the cans but does not include support panels, makes this possible. This relationship is best seen in FIGS. 7 and 9.

Figure 9:
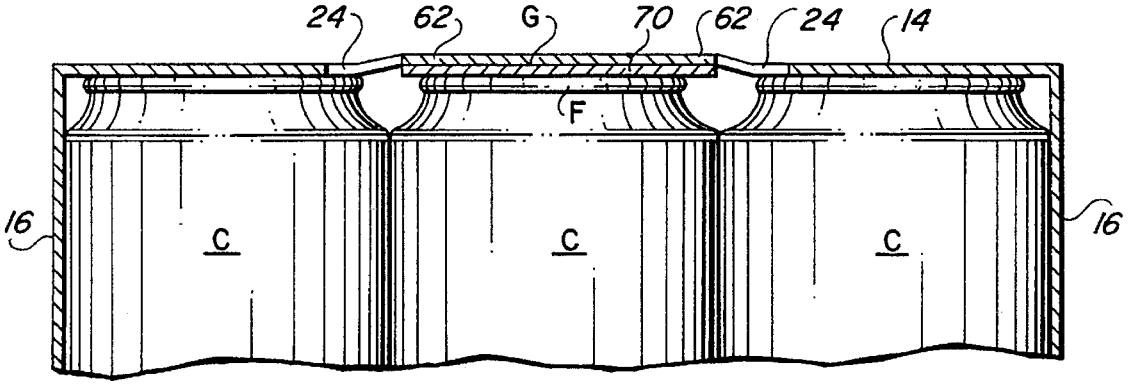
FIG. 9 is an enlarged partial sectional view of the carrier package taken on line 9—9 of FIG. 1.

Because the reinforcement strip is glued to the top panel as indicated in FIGS. 7–9 by the glue layer G, the reinforcement strip functions as an integral part of the carrier, aiding in supporting the end cans in the middle row and also providing the handle strap with two-ply construction. By directly supporting the end cans in the middle row, the reinforcement strip prevents the end cans of the middle row from being squeezed out through the open ends of the carrier, which would be a risk if the integrity of the package depended entirely upon the ability of a packaging machine to tightly wrap a carrier blank around three rows of cans. The addition of the reinforcement strip requires only a minor amount of additional stock for the formation of the blanks, but enables a wrap-around carrier to be used in the packaging of three rows of cans, which is a very substantial economic benefit compared to the cost of packaging three rows in an enclosed carrier.

It will now be clear that the invention improves the ability of wrap-around carriers to be used to package three rows of articles, whether the articles are beverage cans or other types of articles having flanges which can be engaged by the support panels of the reinforcement strip. Obviously, although the invention has been described in connection with a carrier designed to hold twelve beverage cans, the principles of the invention may be incorporated in carriers designed to hold fewer or more articles in each row. Because the invention is not necessarily limited to all the specific details described in connection with the preferred embodiment, except as they may be within the scope of the appended claims, changes to certain features of the preferred embodiment which do not alter the overall basic function and concept of the invention are contemplated.

What is claimed is:

1. A package comprised of a wrap-around carrier containing a plurality of adjacent rows of articles, each article having an upper portion which includes an outwardly projecting flange, comprising:

opposite side panels connected to a top panel and to a bottom panel, the top panel having outer and inner surfaces, opposite end edges and a handle;

a reinforcement panel having substantial portions thereof adhered to the inner surface of the top panel;

the reinforcement panel including a pair of oppositely spaced support panels adjacent each of the end edges of the top panel;

each support panel having spaced end portions which are foldably connected to the reinforcement panel and an intermediate portion which is spaced from the reinforcement panel; and the spaced intermediate portion having an upper edge adjacent the underside of the flange of one said article associated therewith;

whereby said upper edge engages the underside of the flange of the associated article upon lifting the package by the handle of the carrier to thereby assist in supporting said associated articles.

2. A package as defined in claim 1, wherein the reinforcement panel is adhered to the top panel of the carrier by a layer of glue.

3. A package as defined in claim 1, wherein the articles are arranged in three rows, the support panels being associated with the end articles in the middle row.

4. A package as defined in claim 3, wherein each row of articles includes at least three articles, the support panel being comprised of a reinforcement strip extending between the pairs of support panels.

5. A package as defined in claim 4, wherein the handle is comprised of spaced openings in the top panel forming a handle strap therebetween, the reinforcement strip extending beneath the handle strap between the spaced openings.

6. A package as defined in claim 5, wherein each spaced opening is at least partially covered by a flap connected to an inner edge of the opening by a fold line, the reinforcement strip having a width which is no greater than the distance between the fold lines of the handle opening flaps.

7. A package as defined in claim 6, wherein each row of articles contains two interior articles and two end articles, the reinforcement strip overlying the two interior articles of the middle row of articles.

8. A package comprised of a wrap-around carrier containing three rows of containers, each row including two end containers and at least one interior container, each container being substantially circular in cross-section and having an upper portion which includes an inwardly tapered portion terminating in an outwardly projecting flange, comprising:

opposite side panels connected to a top panel and a bottom panel, the top panel having outer and inner surfaces, opposite end edges and a handle;

a reinforcement strip adhered to the inner surface of the top panel and overlying the middle row of containers;

the reinforcement strip including a pair of oppositely spaced support panels adjacent each of the end edges of the top panel;

each support panel being connected to the reinforcement strip by a fold line which is interrupted by a slot through which a portion of the flange of an associated said end container of the middle row extends; and each slot having an edge adjacent the underside of the flange of the associated end container;

whereby said slot edge of each support panel engages the underside of the flange of the associated end container upon lifting the package by the handle of the carrier to thereby assist in supporting said associated end containers.

9. A package as defined in claim 8, wherein the handle is comprised of spaced openings in the top panel forming a handle strap therebetween, the reinforcement strip extending beneath the handle strap between the spaced openings and being adhered to the top panel by a layer of glue.

10. A package as defined in claim 9, wherein each spaced opening is at least partially covered by a flap connected to an inner edge of the opening by a fold line, the reinforcement strip having a width which is no greater than the distance between the fold lines of the handle opening flaps.

11. A package as defined in claim 9, wherein each row of articles contains two interior containers and two end containers, the reinforcement strip overlying the two interior containers of the middle row of containers.

12. A package as defined in claim 8, wherein the containers are beverage cans.

13. A package as defined in claim 8, wherein the wrap-around carrier has open ends.

14. A package as defined in claim 8, wherein each support panel includes stress distribution score lines extending downwardly from said slot edge therein.

* * * * *